US006966465B2

(12) United States Patent
Kang

(10) Patent No.: US 6,966,465 B2
(45) Date of Patent: Nov. 22, 2005

(54) PUMPING DEVICE AND COSMETIC SPRAY HAVING THE SAME

(76) Inventor: Seong Ill Kang, 201-1906, Shin Ahn Apt., 876-16, Bono-dong, Ahnsan-si, Kyeonggi-do 425-180 (KR)

( * ) Notice: Subject to any disclaimer, the term of this patent is extended or adjusted under 35 U.S.C. 154(b) by 66 days.

(21) Appl. No.: 10/250,904

(22) PCT Filed: Jun. 28, 2001

(86) PCT No.: PCT/KR01/01109

§ 371 (c)(1),
(2), (4) Date: Oct. 30, 2003

(87) PCT Pub. No.: WO02/056725

PCT Pub. Date: Jul. 25, 2002

(65) Prior Publication Data

US 2005/0115990 A1 Jun. 2, 2005

(30) Foreign Application Priority Data

Jan. 22, 2001 (KR) ..... 20-2001-1844 U

(51) Int. Cl.[7] ..... B67D 5/40
(52) U.S. Cl. ..... 222/321.9; 222/321.7; 222/380
(58) Field of Search ..... 222/321.1, 321.2, 222/321.7, 321.9, 380

(56) References Cited

U.S. PATENT DOCUMENTS

| | | | | | |
|---|---|---|---|---|---|
| 1,730,684 | A | * | 10/1929 | Phillips | 222/380 |
| 4,369,900 | A | * | 1/1983 | Saito et al. | 222/380 |
| 5,085,353 | A | * | 2/1992 | Inui et al. | 222/402.13 |
| 5,096,098 | A | * | 3/1992 | Garcia | 222/402.13 |
| 5,205,443 | A | * | 4/1993 | Inui et al. | 222/501 |
| 5,429,275 | A | * | 7/1995 | Katz | 222/380 |
| 5,779,106 | A | * | 7/1998 | Albini et al. | 222/380 |

FOREIGN PATENT DOCUMENTS

| | | |
|---|---|---|
| JP | 60-62052 | 4/1985 |
| JP | 60-62053 | 4/1985 |
| JP | 60-62061 | 4/1985 |
| JP | 2-10849 | 1/1990 |
| JP | 4-7008 | 1/1992 |
| JP | 5-13310 | 1/1993 |

* cited by examiner

*Primary Examiner*—Kenneth Bomberg
(74) *Attorney, Agent, or Firm*—Foley & Lardner LLP

(57) ABSTRACT

The present invention relates to a pumping device (110) and a cosmetic bottle using the same. More specifically the present invention relates to a pumping device (110) in which an inserting bar (132) is formed in a upper cap (130) of a nozzle (136) and the nozzle (136) is moved forward and backward according to a pumping operation so that an opening of the nozzle is kept from being clogged by hardening of the gel-type contents.

7 Claims, 9 Drawing Sheets

PUMPING DEVICE AND COSMETIC SPRAY HAVING THE SAME

FIELD OF THE INVENTION

The present invention relates to a pumping device and a cosmetic bottle using the same. More specifically the present invention relates to a pumping device in which an inserting bar is formed in a nozzle and the nozzle is moved forward and backward according to a pumping operation so that an opening of the nozzle is kept from being clogged by the gel-type contents.

BACKGROUND OF THE INVENTION

Generally, a pumping device installed in a cosmetic bottle serves to pump gel-type contents contained the cosmetic bottle to outside in small amount. In FIG. 1, a pumping device and a cosmetic bottle using the same according to the prior art are shown.

As shown FIG. 1, in the main body (1) of the cosmetic bottle, is the gel-type contents (2) contained, and the pumping device is connected to the upper of the main body (1) of the bottle. The pumping device is connected to the main body (1) of the bottle by a supporting body (3). And a cylinder (4) is coupled in the supporting body (3). A suction pipe (5) is connected to the bottom of the cylinder (4) and extends to the inner of the main body (1), and an open-close bar (6) is provided in the cylinder (4). A piston (7) is interposed between the cylinder (4) and the open-close bar (6) and is supported by a spring (8), and a transferring pipe (9) is coupled to the upper of the piston (7) and a cap (10). A suction valve (11) is coupled to the bottom of the open-close bar (6) so that the connecting path between the cylinder (4) and the suction pipe (5) is blocked. Also a pumping valve (12) is coupled to the upper of the transferring pipe (9) such that the connecting path between the nozzle (13) and the transferring pipe (9) which are formed on the cap (10) is blocked.

The pumping device having above constitution operates as follow. First, when the cap (10) is pressed, the transferring pipe (10) and the piston (7) are descended so that a gap is formed between the piston (7) and the open-close bar (6), thus the gel-type contents in the cylinder (4) can be moved through the gap. That is, because the pressure of the inner of the cylinder (4) according to the descending of the piston (7) the contents contained in the cylinder (4) pushes the pumping valve (12) so that they are pumped outside through the nozzle (13) formed in the cap (10).

When the pressing against the cap (10) is disappeared after the contents being pumped, the piston (7) is ascended by the elastic force of the spring (8). Accordingly, the pressure in the cylinder (7) is decreased, thus the contents (2) contained in the main body (1) of the bottle is entered into the cylinder (4) following to the suction pipe (5) while the edge of the suction valve (11) is risen.

The pumping device in prior art above-mentioned has problem as follow. As shown FIG. 1, the gel-type contents are filled in the suction pipe (5), the inner of the cylinder (4), the inner of the transferring pipe (9) and the inner of the nozzle (13) as well as the main body (1) of the bottle. However, in many cases, the contents (14) at the tip of the nozzle (13) are hardened or deteriorated because they are always contacted to the air in outside. Accordingly, the nozzle (13) may be clogged by the hardened contents or the reliability of the products may be suffered from the deteriorated contents (14).

SUMMARY OF THE INVENTION

Accordingly, the object of the present invention provides a pumping device having a new structure which can solve the problem in that the contents at the tip of the cosmetic bottle are hardened or deteriorated by reacting with the air, and a cosmetic bottle using the same.

In order to achieve the object, the present invention provides a cosmetic bottle in which an opening of the nozzle is plugged by forming an inserting bar in the nozzle and the nozzle can be moved to forward and backward according to the pumping operation thus the hardening or the deteriorating of the contents at the opening of the nozzle being prevented.

DETAILED DESCRIPTION OF THE PREFERRED EMBODIMENTS

Hereinafter, the preferred embodiment of the present invention is described according to the attached drawings.

Figure 1:
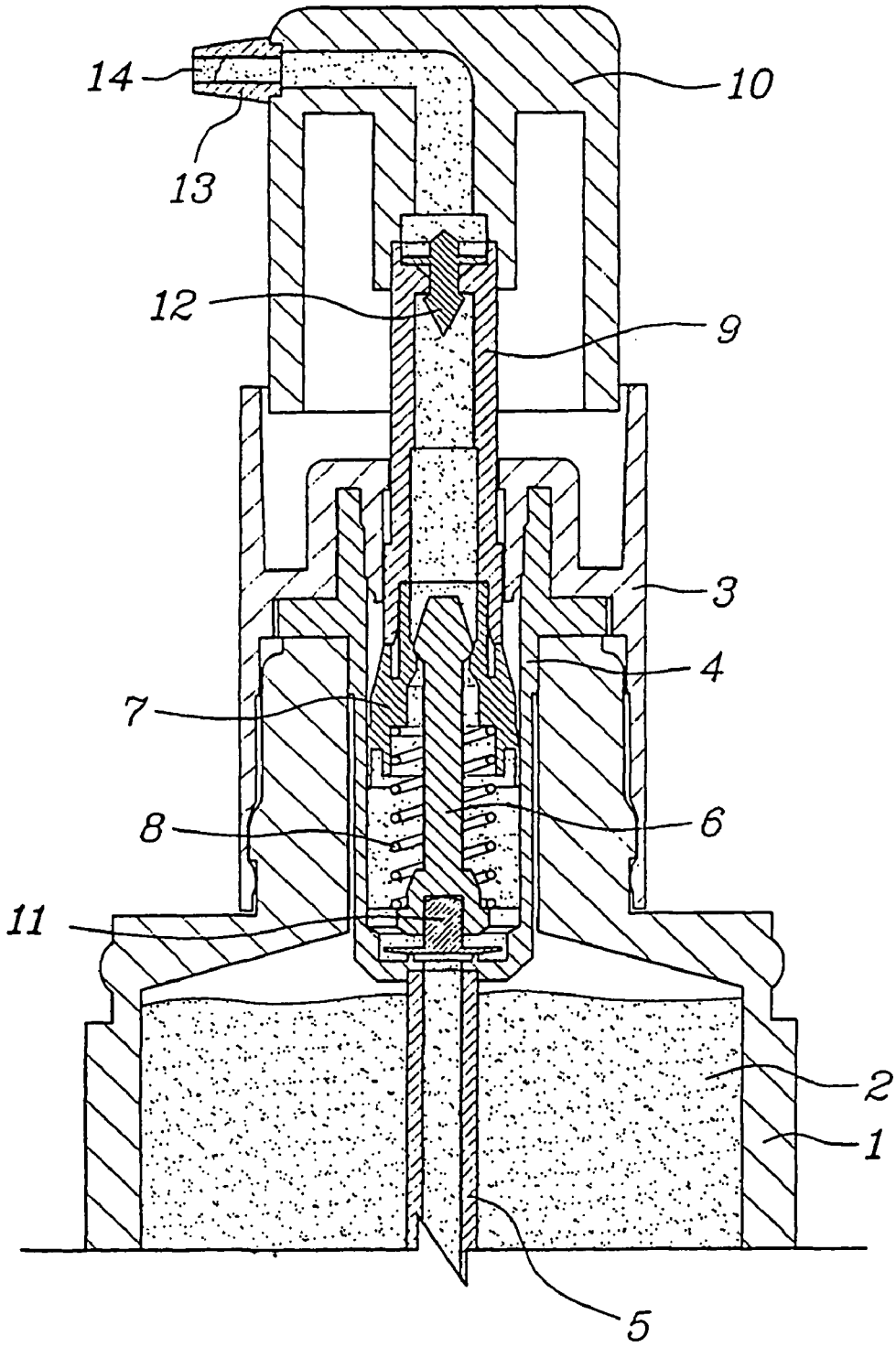
FIG. 1 is a sectional view showing the pumping device of a cosmetic bottle in prior art.
Figure 2:
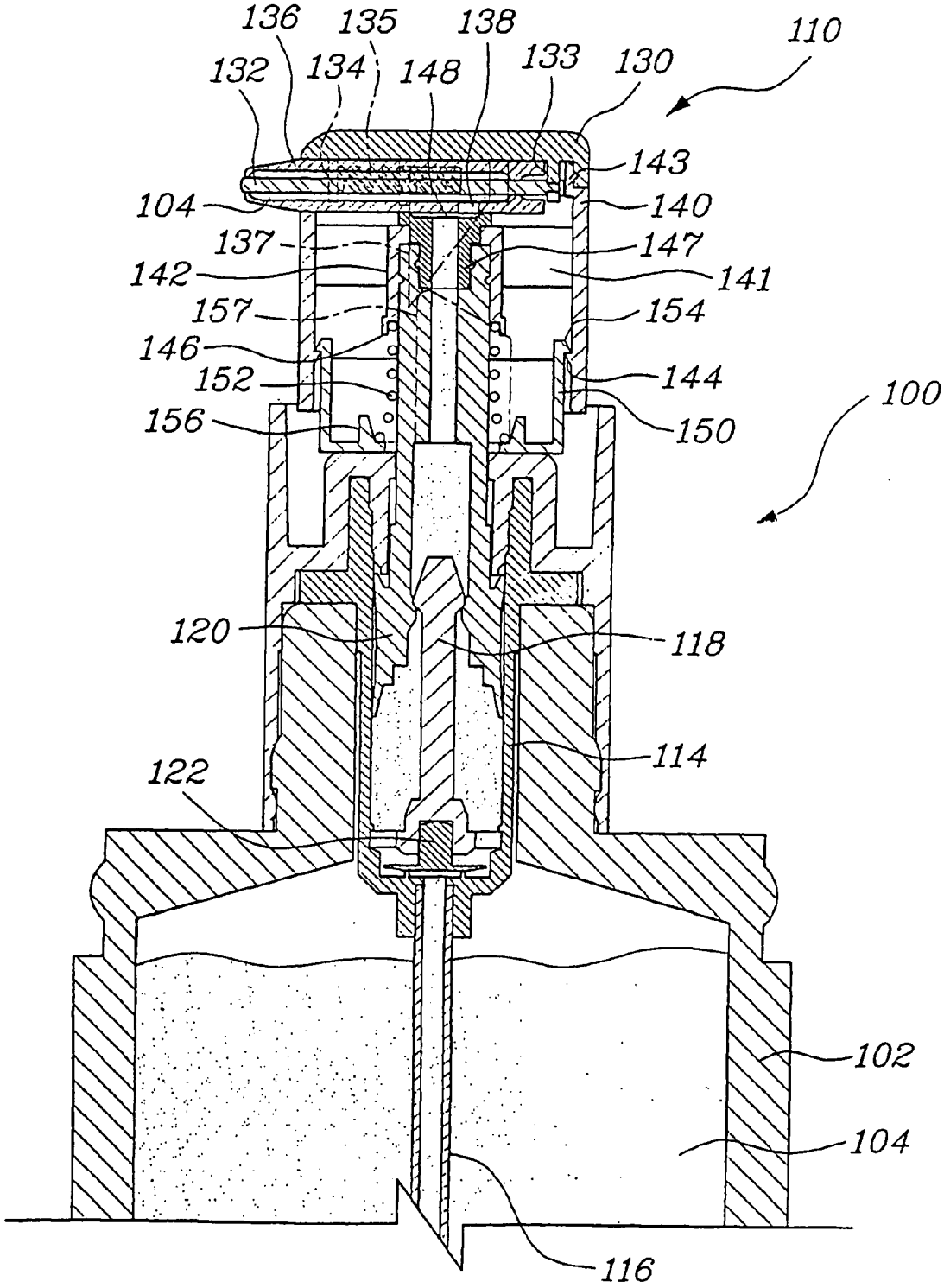
FIG. 2 is a sectional view showing the pumping device of a gel-type cosmetic bottle according to the present invention.

FIG. 2 is a sectional view showing the pumping device of a gel-type cosmetic bottle according to the present invention. As shown the figure, in the main body (102) of the cosmetic bottle (100), are gel-type contents (104) contained, and a pumping device (110) is connected to the upper of the main body (102).

The pumping device (110) is coupled to the main body (102) by a supporting body (112), and a cylinder (114) is coupled in the supporting body (112). A suction pipe (116) is connected to the bottom of the cylinder (114) and extends in the main body (102), and an open-close bar (118) is provided in the cylinder (114). A piston (120) is interposed between the cylinder (114) and the open-close bar (118), and the piston (120) is extended to the upper direction and connected to a middle cap (140; described hereinafter). A suction valve (122) is coupled to the bottom of the open-close bar (118) so that the connecting path between the cylinder (114) and the suction pipe (116) is blocked.

It is a characteristic of the pumping device (100) according to the present invention to be divided into three parts.

Figure 3:
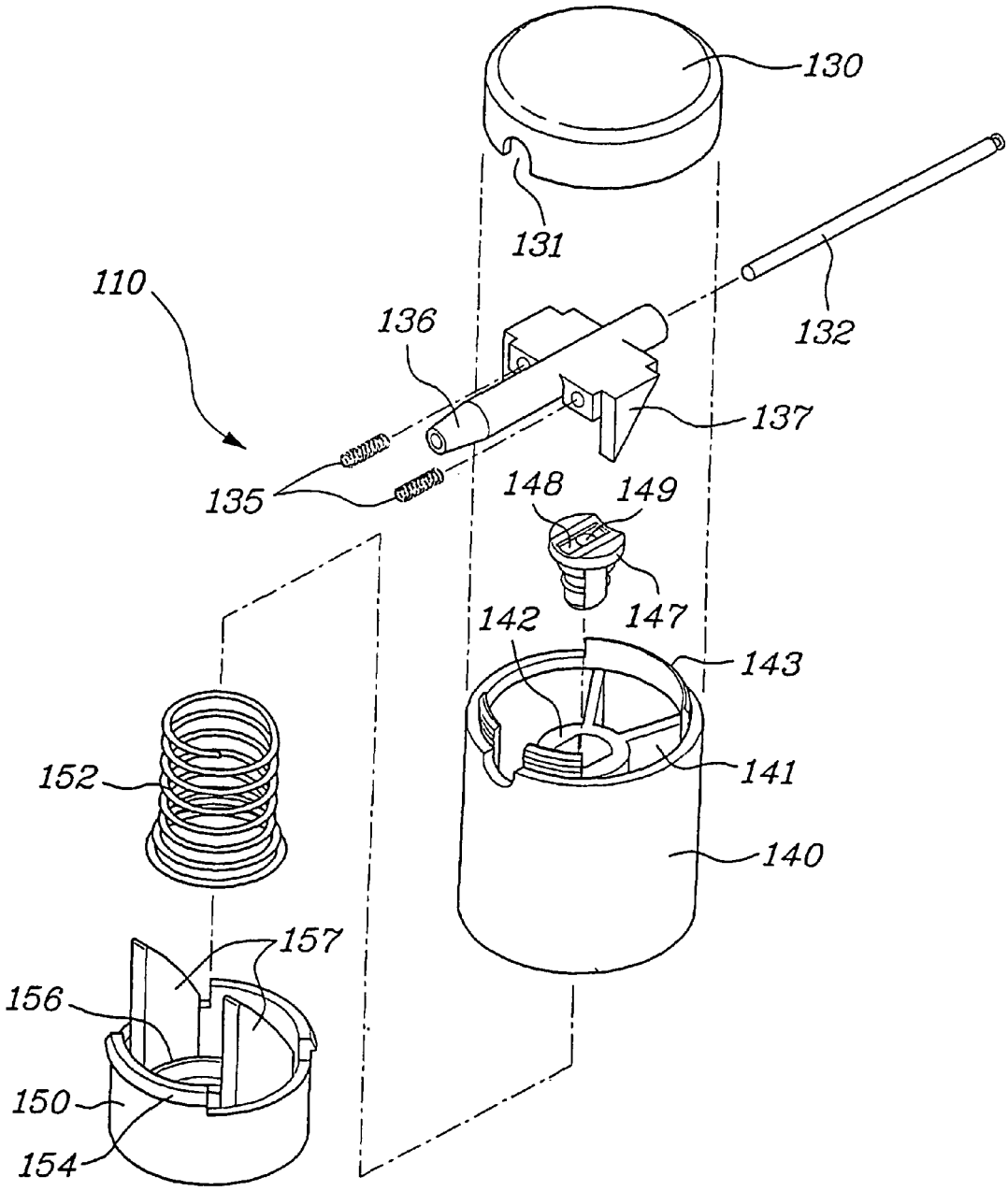
FIG. 3 is an exploded view showing the main parts of the pumping device of a gel-type cosmetic bottle according to the present invention.
Figure 4A:
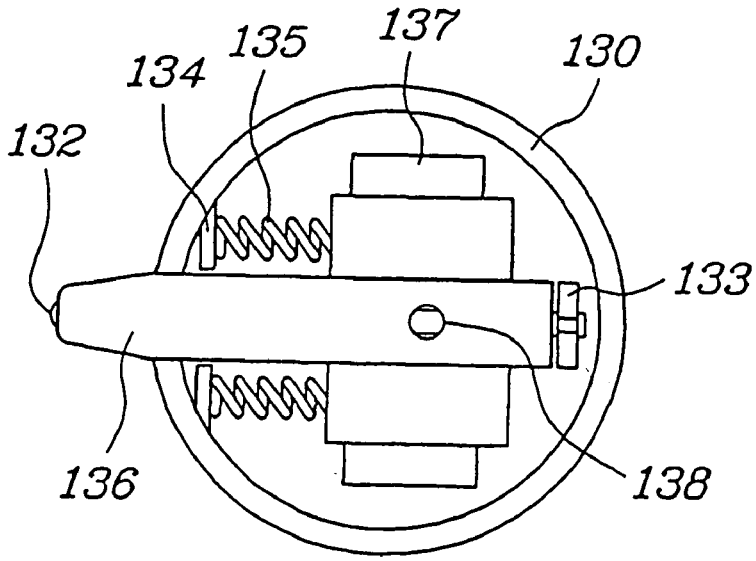
FIG. 4*a* and FIG. 4*b* are respectively a bottom view and a sectional view showing the upper cap of the pumping device of a gel-type cosmetic bottle according to the present invention.
Figure 4B:
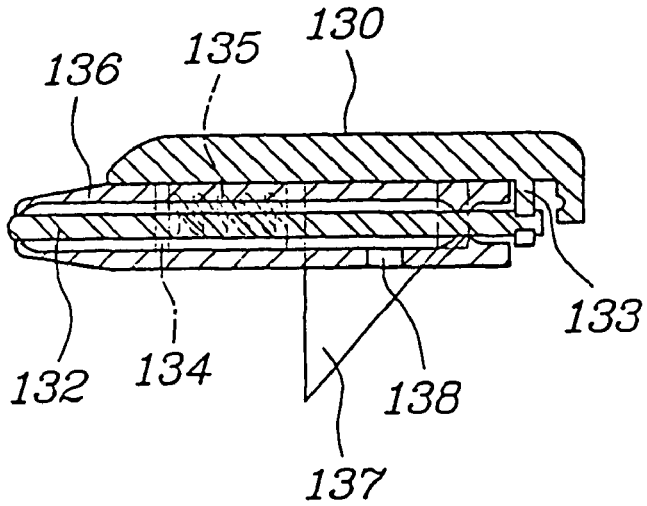
Figure 5A:
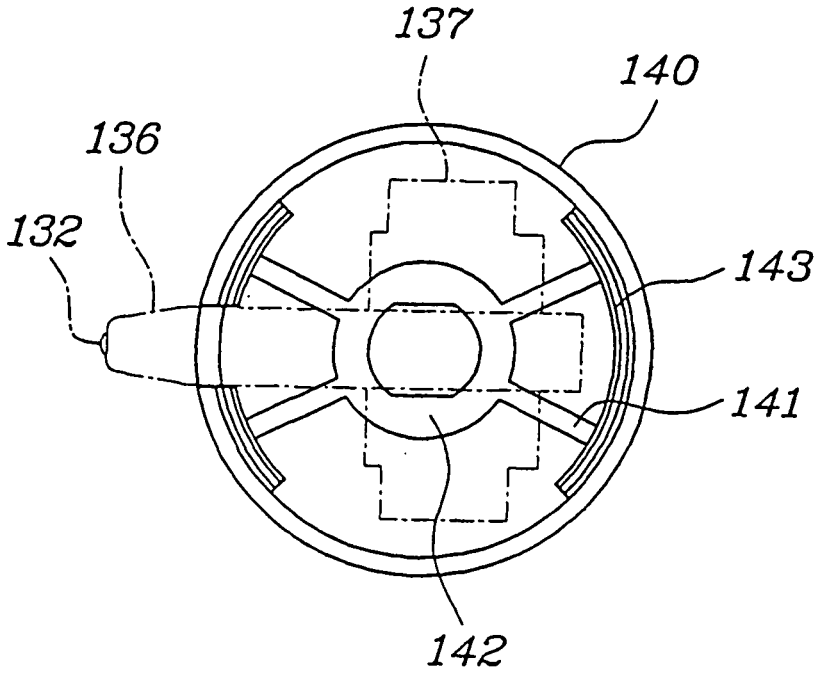
FIG. 5*a* and FIG. 5*b* are a plan view and a sectional view showing the middle cap of the pumping device of a gel-type cosmetic bottle according to the present invention.
Figure 5B:
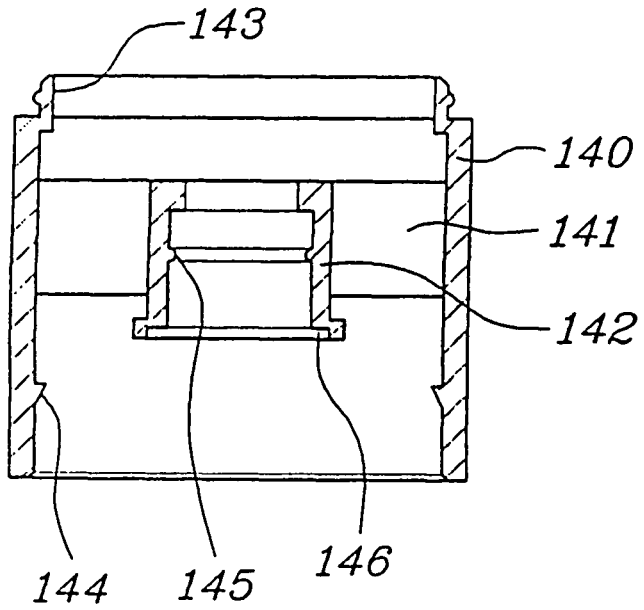
Figure 6A:
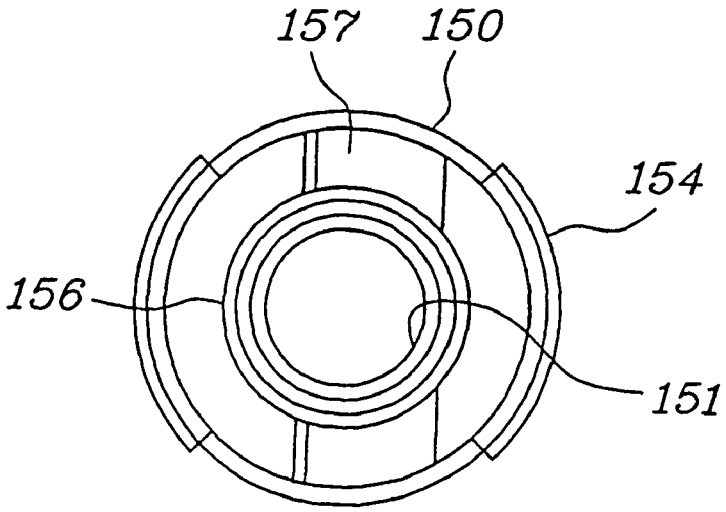
FIG. 6*a* and FIG. 6*b* are a plan view and a sectional view showing the bottom cap of the pumping device of a gel-type cosmetic bottle according to the present invention.
Figure 6B:
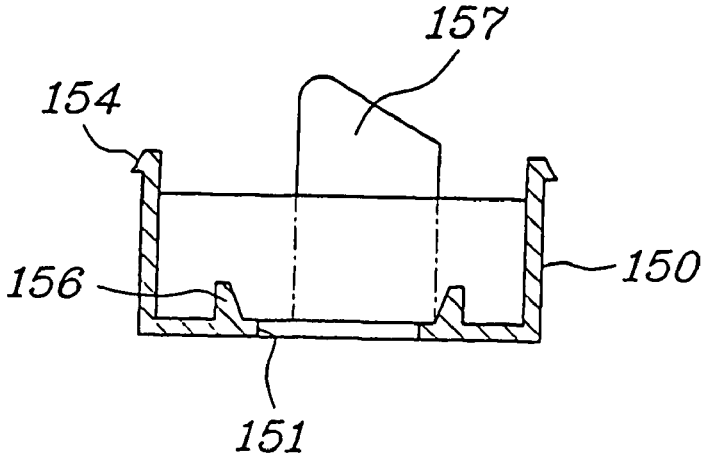

Hereinafter, the three parts are referred as to the upper cap (130), the middle cap (140) and the bottom cap (150). Thc major parts of each cap are shown in the exploded view in FIG. 3, especially the upper cap (130) being well shown in the bottom view of FIG. 4*a* and in the sectional view of FIG. 4*b*, the middle cap (140) being well shown in the plan view of FIG. 5*a* and the sectional view of FIG. 5*b*, and the bottom cap (150) being well shown the plan view of FIG. 6*a* and the sectional view of FIG. 6*b*, respectively.

As shown FIG. 2, FIG. 3, FIG. 4*a* and FIG. 4*b*, the upper cap (130) comprises a nozzle groove (131), an inserting bar (132), a fastening member for an inserting bar (133), a spring fixing bar (134), a first spring (135), a nozzle (136), a upper sliding member (137) and an inlet (138). Also, as shown FIG. 2, FIG. 3, FIG 5*a* and FIG. 5*b*, a middle cap (140) comprises a rib (141), a piston fastening pipe (142), a upper fastening jaw (143), a lower catching jaw (144), a piston fixing jaw (145), a spring supporting groove (146), a pumping pipe (147) a inflow groove (148) and an outlet (149). Furthermore, as shown FIG. 2, FIG. 3, FIG. 6*a* and FIG. 6*b*, the bottom cap (150) comprises a piston insert hole (151), a second spring (152), a upper end catching jaw (154), a spring supporting jaw (156) and a bottom sliding member (157).

Hereinafter, the structure of each cap (130, 140, 150) in the pumping device (110) is described. ID the bottom cap (150) and the middle cap (140), the upper catching jaw (154) formed on the outside of the upper end of the bottom cap (150) and the bottom catching jaw (144) formed on the inner of the bottom end of the middle cap (140) are caught by each other, and they are coupled by the second spring (152) is interposed between the spring supporting jaw (156) of the bottom cap (150) and the spring supporting groove (146). The middle cap (140) is caught to the upper cap (130) by the upper catching jaw (143) formed its upper end.

The piston (120) of the pumping device (110) is coupled a piston fixing jaw (145) by being interposed the piston catching pipe (142) formed in the middle of the middle cap (140) through a piston insert hole (151) formed in the middle of the lower surface of the bottom cap (150). The piston catching pipe (142) is formed in the middle of the middle cap (140) by the rib (141). On the upper of the piston catching pipe (142), is the pumping pipe (147) interposed to the piston catching (142) and the inner of the piston (120). The pumping hole (149) is formed in the middle of the exhausting pipe (147), and straight inflow groove (148) is formed on the upper of it. The pumping hole (149) is positioned in the middle of the, inflow groove (148).

An inserting bar catching member (133) is formed on one edge of the bottom of the upper cap (130), and an inserting bar (133) is extended to a nozzle groove (131) formed on the opposing edge across the upper end cap (130) after being caught to the inserting bar catching member (133). The inserting bar (132) is inserted into the nozzle (136) so that the opening of the nozzle is blocked. Part of the nozzle (136) is protruded to outside through the nozzle groove (131). Two spring fixing members (134) are formed in the bottom of the upper cap (130) being close to the inflow groove (131), and one end of a first spring (135) is coupled to the spring fixing member (134), respectively. The other end of the first spring (135) is coupled to the upper sliding member (137) disposed in the middle of the upper end cap (130). The upper sliding member (137) and the nozzle (136) are formed integrally. The upper sliding member (137) is contacted with the bottom sliding member (157) formed on the edge of the bottom cap (150). An inlet (138) is formed on the bottom on the nozzle (136), and it is positioned in the inflow groove (148) formed in the pumping pipe (147) but it can be positioned cross with the pumping opening (149).

Figure 7A:
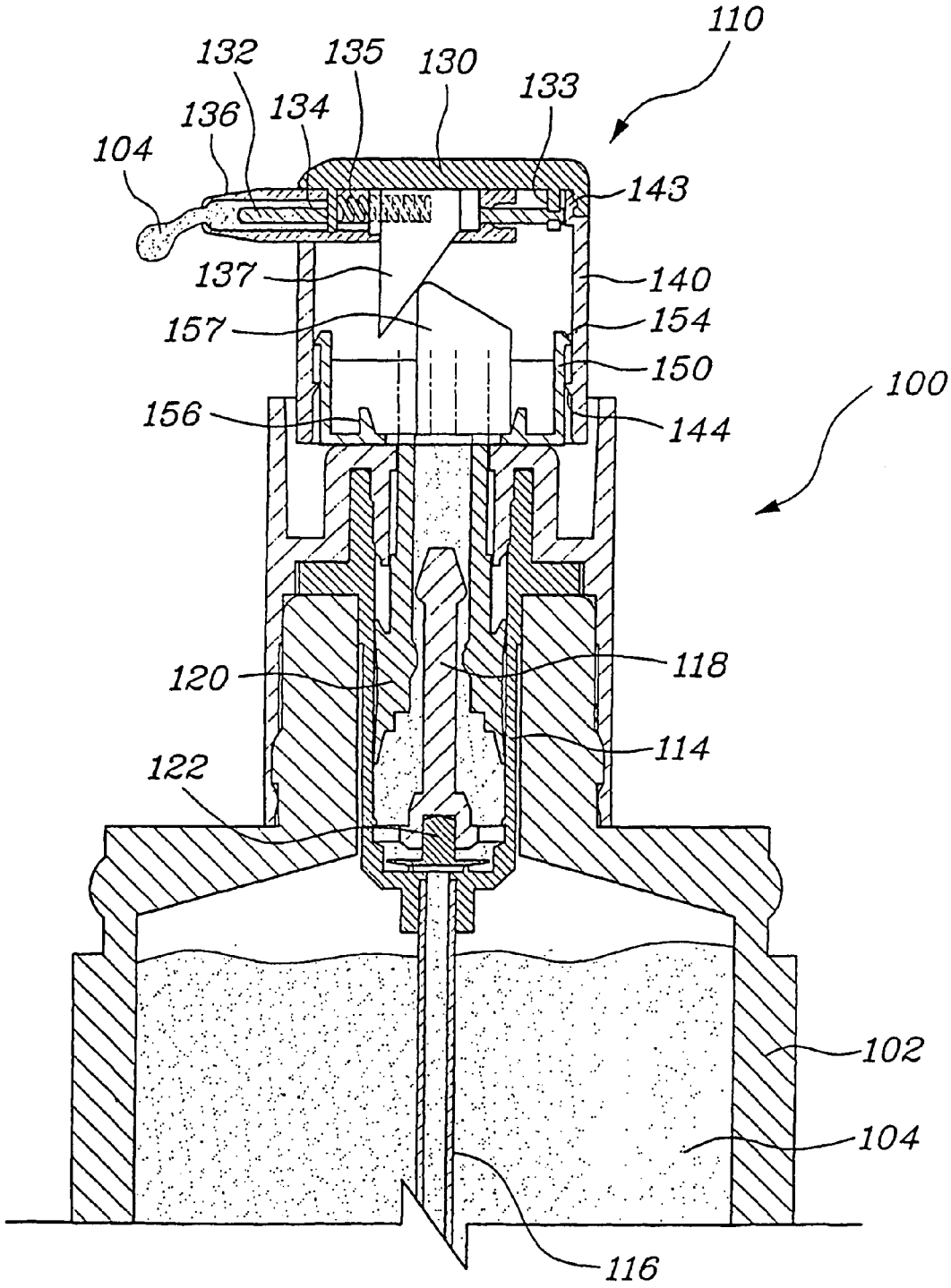
FIG. 7*a* and FIG. 7*b* are a longitudinal sectional view describing the operation of the pumping device for a gel-type cosmetic according to the present invention.
Figure 7B:
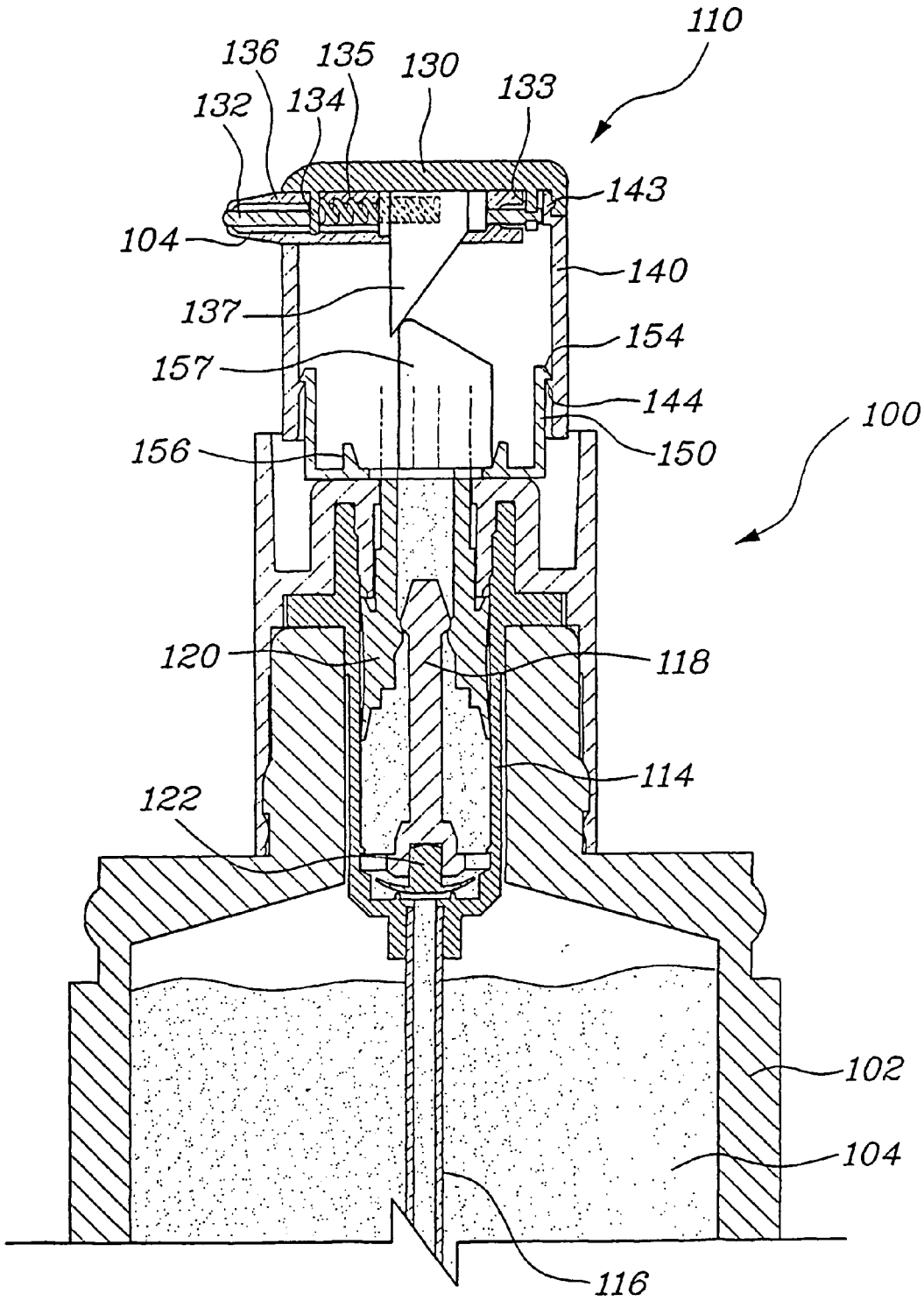
Figure 8A:
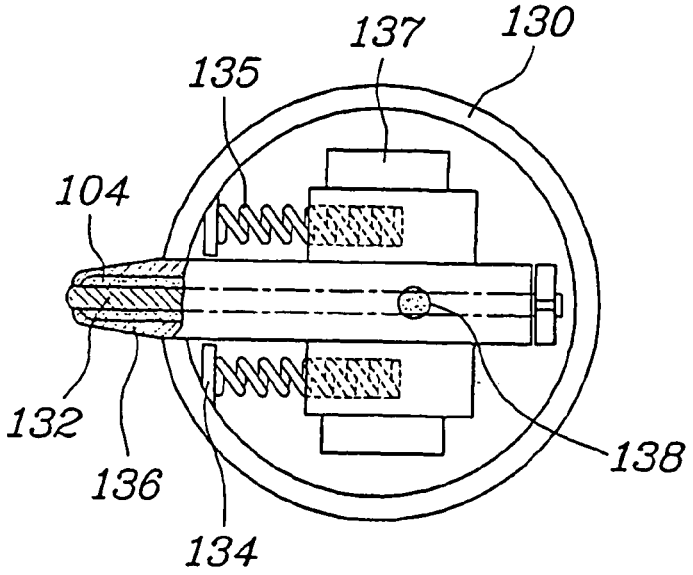
FIG. 8*a* and FIG. 8*b* are a cross sectional view describing the operation of the spraying device for a gel-type cosmetic according to the present invention.
Figure 8B:
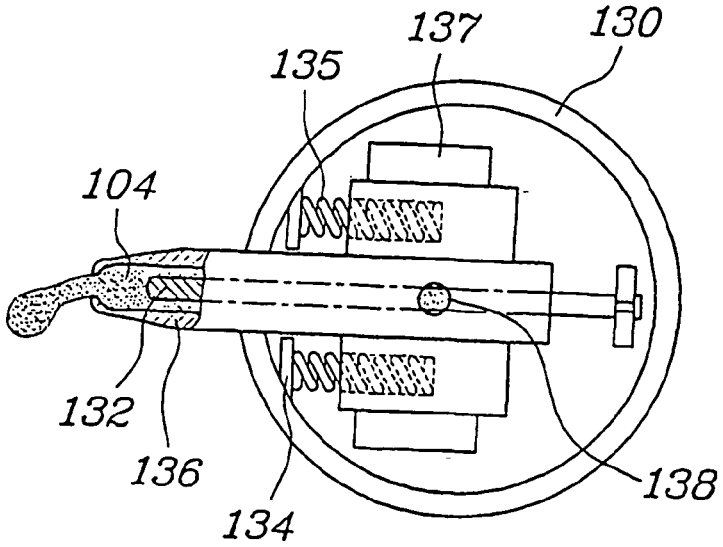

The pumping device (110) as above mentioned operates as follow. It is clear that the structure of the pumping device (110) from the operation of the pumping device (110) described hereinafter. FIG. 7*a* and FIG. 7*b* show the operation of the pumping device as a longitudinal sectional view, and FIG. 8*a* and FIG. 8*b* show the operation of the pumping device as cross sectional view. Also, FIG. 7*a* and FIG. 8*a* show the condition which the upper cap (130) is not pressed (that is, not used) as a corresponding view each other, and FIG. 7*a* and FIG. 8*b* show the condition which the upper cap (130) is pressed (that is, used) as a corresponding view each other.

When, the upper cap (130) is not pressed, the upper sliding member (137) and the bottom sliding member (157) are not contacted at their ends each other, the opening of the nozzle (136) is blocked by the inserting bar (132). Accordingly, when the bottle (100) is not used, the nozzle (136) of the cosmetic bottle (100) is always blocked, thus the gel-type contents (104) contained in the nozzle (136) are not contacted to the air outside.

Also, when the upper cap (130) is pressed, the upper sliding member (137) presses the first spring (135) while it slides in contact with the bottom sliding member (157) fixed to the bottom cap (150), and the nozzle (136) formed on the upper sliding member (137) integrally is moved forward. However, the inserting bar (132) is still fixed to the inserting bar catching member (133) of the upper end cap (130). Thus, when the opening of the nozzle (136) is opened, the gel-type contents (104) contained it is pumped to outside.

When the upper cap (130) is pressed, the middle cap (140) caught to the upper cap (130) is pressed toward the bottom. Then, the middle cap (140) presses the second spring (152) and the piston (120) caught to the piston catching pipe (142) simultaneously. The space in the cylinder (114) is diminished and a gap is formed between the piston (120) and the open-close bar (118) according to descending of the piston (120). As result, the hydraulic pressure in the cylinder (114) is higher then the contents in the cylinder (114) are provided to the pumping pipe (147) formed on the upper of the piston (120). Subsequently, the contents provided in the pumping pipe (147) are entered the inlet (138) of the bottom of the nozzle (136) through the pumping hole (147) and the inflow groove (148). As above mentioned, although the nozzle (136) is moved forward and backward, the flow of the contents is not affected because the inlet (138) of the nozzle (136) is moved only in the inflow groove (148) of the pumping pipe (147).

When the force pressing the upper cap (130) is disappeared, the middle cap (140) is ascended to original position by the elastic force of the second spring (152). Thus, the upper cap (130) caught to the middle cap (140) is ascended, and the upper sliding member (137) is retracted to original position by the elastic force of the first spring (135). The nozzle (136) integrally formed on the upper sliding member (137) is also be retracted in backward then the opening of the nozzle (136) is blocked by the inserting bar (132). Also, the piston (120) is ascended simultaneously according to the ascending of the middle cap (140), this the gap between the piston (120) and the open-close bar (118) is clogged. Accordingly, the suction valve (122) is opened while the hydraulic pressure in the cylinder (114) is decreased, and the contents (104) of the main body (102) are provided in the cylinder (114) through the suction pipe (116).

As above described, when the cosmetic bottle using the gel-type cosmetic pumping device according to the present invention, the gel-type contents in the nozzle are cut off from the air in outside because the opening of the nozzle is blocked by the inserting bar. Accordingly, the present invention has an effect that the problem in that the contents are hardened or deteriorated as the prior art is prevented in essence, and it can contribute to improve the reliability of the products.

What is claimed is:

1. A gel-type cosmetic pumping device of cosmetic bottle (100) being coupled to the upper of the main body (102) where a gel-type contents (104) is contained and comprising a cylinder (114) formed in said pumping device (110); a suction pipe (116) connected to the bottom of said cylinder (114) and extended into said main body (102); an open-close bar (118) provided in said cylinder (114); a piston (120) interposed between said cylinder (114) and said open-close bar (118); a suction valve (122) coupled to the bottom of said open-close bar (118), wherein said pumping device (110) further comprises the upper cap (130), the middle cap (140) and the bottom cap (150), wherein a second spring (152) being interposed between said bottom cap (150) and said middle cap (140), said middle cap (140) being caught to said upper cap (130), said piston (120) being interposed and coupled in said middle cap (140) through said bottom cap (150), an inserting bar (132) coupled to said upper cap (130) being inserted in a nozzle (136) then an opening of said nozzle (136) being blocked, a first spring (135) coupled to said upper cap (130) being coupled to the upper sliding member (137) formed integrally with said nozzle (136), said upper sliding member (137) being contacted to the bottom sliding member (157) formed on said bottom cap (150), wherein when said upper cap (130) in descended, said upper sliding member (137) and said nozzle (136) are moved forward, then the opening of said nozzle (136) is opened and gel-type contents (104) are pumped outside.

2. A gel-type cosmetic pumping device according to claim 1, wherein said bottom cap (150) and said middle cap (140) are coupled with each other by catching the upper catching jaw (154) formed on the outside of the upper of said bottom cap (150) and the bottom catching jaw (144) formed in inside of the bottom of said middle cap (140), and by interposing said second spring (152) between a spring supporting jaw (156) of said bottom cap (150) and a spring supporting groove (146) of said middle cap (140).

3. A gel-type cosmetic pumping device according to claim 1, wherein said piston (120) is coupled to a piston fixing jaw (145) by being interposed in a piston catching pipe (142) formed in the middle of said middle cap (140) through a piston inserting hole (151) formed in the middle of the bottom surface of said bottom cap (150).

4. A gel-type cosmetic pumping device according to claim 1, wherein a pumping pipe (147) is provided on the upper of said middle cap (140), and a pumping opening (149) is formed in the middle of said pumping pipe (147).

5. A gel-type cosmetic pumping device according to claim 4, wherein straight inflow groove (148) is formed on the upper of said pumping pipe (147), and said pumping opening (149) is positioned in the middle of said inflow groove (148).

6. A gel-type cosmetic pumping device according to claim 1, wherein an inflow opening (138) is formed on the bottom of said nozzle (136), and said inflow opening (138) is positioned in said inflow groove (148).

7. A gel-type cosmetic pumping device according to claim 1, wherein an inserting catching member (133) is formed on one edge of the bottom of said upper cap (130), and a nozzle groove (131) is formed on the opposing edge of said bottom of said upper cap (130), wherein, said upper cap (130) is extended toward said nozzle groove (131) after said inserting bar (132) is caught to said inserting bar catching member (133).

* * * * *